United States Patent [19]

Connor

[11] 4,199,309

[45] Apr. 22, 1980

[54] CIRCULAR CAVITY DISCHARGE VALVE

[75] Inventor: Ralph F. Connor, Evansville, Ind.

[73] Assignee: Whirlpool Corporation, Benton Harbor, Mich.

[21] Appl. No.: 871,388

[22] Filed: Jan. 23, 1978

[51] Int. Cl.[2] ..... F04C 29/08; F04B 39/10; F16K 15/14

[52] U.S. Cl. ..... 418/270; 137/856

[58] Field of Search ..... 137/856, 855, 853, 852, 137/857; 418/270, 259; 417/559

[56] References Cited

U.S. PATENT DOCUMENTS

| | | | |
|---|---|---|---|
| 2,87,946 | 3/1959 | Garrison et al. | 418/2 X |
| 1,911,939 | 5/1933 | Belyavin | 137/454.4 |
| 2,065,062 | 12/1936 | Dugelax | 137/512 |
| 2,191,970 | 2/1940 | Meiser | 137/855 X |
| 2,904,971 | 9/1959 | Kosfeld | 62/196 R |
| 3,568,712 | 3/1971 | Rinehart | 137/855.5 |
| 3,809,511 | 5/1974 | Linder et al. | 418/259 |
| 3,811,468 | 5/1974 | Bellmer | 137/512.15 |
| 3,882,891 | 5/1975 | Viles et al. | 137/512.15 |
| 3,998,243 | 12/1976 | Osterkorn et al. | 137/856 |
| 4,088,428 | 5/1978 | Bannister et al. | 137/855 |

FOREIGN PATENT DOCUMENTS

| | | | |
|---|---|---|---|
| 2430220 | 1/1975 | Fed. Rep. of Germany | 418/270 |
| 2635973 | 2/1978 | Fed. Rep. of Germany | 418/270 |

*Primary Examiner*—Leonard E. Smith

*Attorney, Agent, or Firm*—Wegner, Stellman, McCord, Wiles & Wood

[57] ABSTRACT

A compressor discharge valve assembly utilizing a cylindrical cavity in which is provided a discharge flow control valve and a valve stop for limiting the opening movement of the valve during operation of the compressor. The discharge valve chamber defines a cylindrical portion into which opens an outlet from the compression chamber. A cylindrical recess is provided in the wall of the discharge valve chamber for receiving a securing portion of the valve stop. The valve stop may further include a spacer for maintaining an arcuate backup portion thereof in inwardly spaced relationship to the valve. The valve is biased to engage the discharge valve chamber wall adjacent the outlet passage. The valve may be defined by a resilient arcuate member secured at one end to the valve stop whereby the valve is cantilevered from the securing means to extend over an arc of approximately 180° to have a distal portion disposed in closing relationship to the outlet passage.

23 Claims, 6 Drawing Figures

CIRCULAR CAVITY DISCHARGE VALVE

BACKGROUND OF THE INVENTION

1. Field of the Invention

This invention relates to compressors and in particular to discharge valve control means for use in a rotary compressor.

2. Description of the Prior Art

In copending application Ser. No. 713,709 now U.S. Pat. No. 4,088,428 of James E. Bannister and Ralph F. Connor, the latter being applicant herein and which application is owned by the assignee hereof, a discharge valve assembly for a compressor is disclosed as comprising a reed-type valve mounted on a retainer having spaced locating projections for positioning the assembly in a compressor valve chamber. The retainer has arcuate end portions having a curvature greater than corresponding end portions of the valve chamber whereby the retainer and valve are locked securely in position in the chamber by the distortion of the end portions and projections on the retainer. The valve chamber defines a planar surface at the outlet from the compression chamber and is provided with rounded end portions engaged by the rounded end portions of the retainer. The valve member defines a rectilinear element having an end portion overlying the compression chamber outlet passage.

In U.S. Pat. No. 2,065,062, Paul Dugelay shows a somewhat similar valve for high speed compressors wherein the valve defines a rectilinear member with a curved valve stop cantilevered behind the valve member.

George H. Meiser, in U.S. Pat. No. 2,191,968, shows an attachment for internal combustion engines wherein a threaded connector is threaded into the spark plug mounting opening of the engine wall. After the device is installed in the spark plug opening, the engine is operated so as to pump air from the cylinder through the device such as for effecting tire inflation and the like. The Meiser fitting utilizes a flapper-type valve having semicylindrical valve elements and a semicylindrical valve stop for controlling movement of the valve elements. The valves serve as check valves and are disclosed as formed of rubber or other similar flexible material. The valves are held in position by a cage which is confined between spaced end walls of the device. The cage may be provided with projections extending into diametrically opposed vertical grooves in a casing portion of the device.

Milton M. Kosfeld shows, in U.S. Pat. No. 2,904,971, a superheat coil by-pass for use in a refrigeration apparatus wherein a valve stop in the discharge valve chamber is secured to the chamber wall by an end portion received in a groove in the chamber wall.

In U.S. Pat. No. 3,568,712, Dean C. Rinehart shows a V-shaped valve member anchored in a recess opening into the compression chamber. The valve element includes an angled end portion fitting into a slot in the recess for securing the valve to the compressor member.

Ernst Linder et al, in U.S. Pat. No. 3,809,511, show a valve arrangement for a compressor having semicylindrical springs received in the discharge valve chamber for holding the valve assembly in place. The valve member and valve stop are secured by rivets received in a recess opening into the discharge valve chamber.

Friedrich O. Bellmer discloses, in U.S. Pat. No. 3,811,468, a compressor valve assembly utilizing a resilient U-shaped reed having a first end portion adpated to cover the valve chamber port and a second end portion held stationary against the wall opposite the port. A backer plate is positioned between the first and second end portions of the reed to intercept the movement of the first end portion for limiting the displacement of the reed from the closed position. The cavity is generally rectangular and defined by opposed parallel walls.

In U.S. Pat. No. 3,882,891, Alan H. Viles et al disclose a check valve having a split tubular valve member adapted to be secured to the wall of the tubular fluid conductor either internally or externally thereof for controlling flow through one or more slotted ports in the flow member.

Charles L. Osterkorn et al, in U.S. Pat. No. 3,998,243, show a flapper valve for a rotary compressor having a valve element spot-welded to a valve retainer. The valve is substantially planar and is seated against a substantially planar portion of the compressor structure defining the flow passage. The valve stop curves away from the valve and is provided with a plurality of support portions resting on an opposite wall of the discharge valve chamber.

SUMMARY OF THE INVENTION

The present invention comprehends an improved compressor apparatus wherein the compressor discharge valve is disposed within a cylindrical discharge valve chamber and is defined by a generally semicylindrical valve member and a generally semicylindrical valve stop.

The invention further comprehends such a compressor apparatus wherein the valve stop is provided with a securing portion received in a cylindrical recess opening into the discharge valve chamber. The securing portion of the valve stop may comprise an integral tab portion thereof.

The valve may be secured to the valve stop adjacent the securing portion.

The recess in which the securing portion is secured may be spaced substantially from the outlet passage leading from the compression chamber to be controlled by the valve. The valve member is cantilevered substantially semicylindrically from the secured end thereof into normally biased closed relationship with the outlet opening.

The valve stop may include a distal end having a turned portion received in a second recess opening into the discharge valve chamber for assisting in retaining the valve stop in secured position within the discharge valve chamber. The valve stop may further be provided with spacing means for maintaining the backup portion of the valve stop in preselected accurate spaced relationship to the valve chamber wall at the outlet from the compression chamber.

The valve member is made to be accurately complementarily segmentally cylindrical so as to have facial engagement with the cylindrical surface of the wall means defining the discharge valve chamber at the outlet thereby to assure a positive closing of the outlet flow passage when the valve member is in the outlet-closing position.

The valve member may comprise a rolled metal member. The outlet-closing end of the valve member may be suitably preformed to permit a final rolling operation to form the valve member into accurate conformity with the configuration of the discharge valve chamber wall.

The cylindrical discharge valve chamber may be located suitably so as to define a minimum length outlet flow passage so as to minimize the volume of the flow passage communicating between the compression chamber and the discharge valve chamber, thereby substantially increasing the efficiency of the compressor over the conventional compressor constructions wherein the outlet passage has a substantial length and thus relatively large volume.

The use of the cylindrical discharge valve chamber further provides extremely low cost in the manufacture of the compressor as the discharge valve chamber may be formed by simple drilling apparatus. The recess discussed above for use in securing and positioning the valve assembly may similarly be formed by simple drilling operations to define cylindrical recesses opening laterally into the cylindrical discharge valve chamber. In the illustrated embodiment, the axes of each of the cylindrical recesses and valve chamber may be parallel to the axis of the compression chamber.

More specifically, in one forming method, the end portion of the metal blank is preformed to approximately the cylindrical curvature of the wall surface and the entire element is then roll formed to cause the preformed end portion to have the desired highly accurate conformity with the cylindrical wall surface. Alernatively, the end portion may be displaced several thousands of an inch from the remainder of the blank in lieu of the arcuate preforming operation.

Thus, the compressor apparatus of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
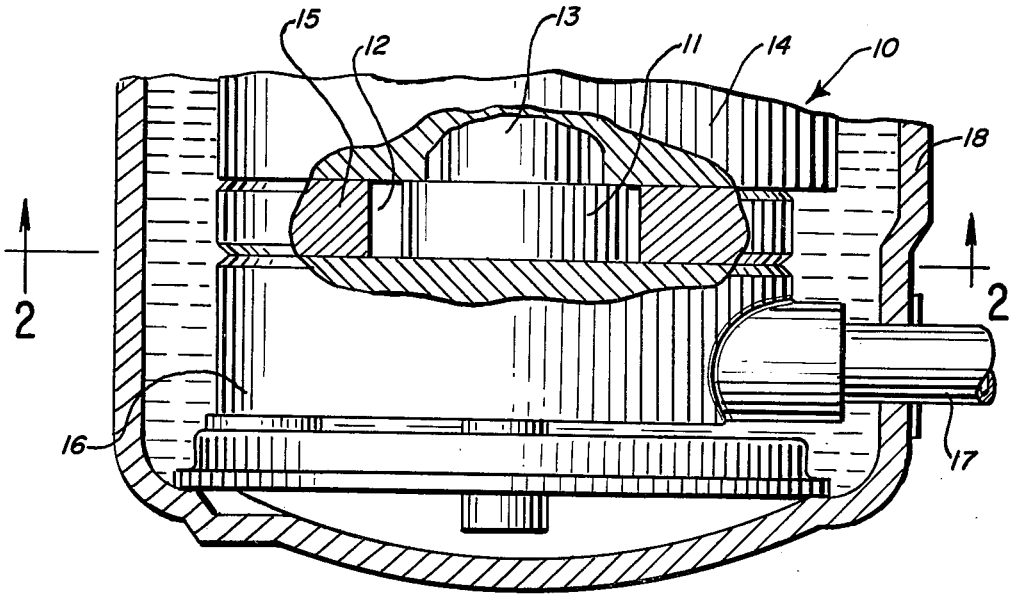
FIG. 1 is a fragmentary elevational view of a portion of a compressor apparatus embodying the invention.

In the exemplary embodiment of the invention as disclosed in the drawing, a rotary compressor generally designated 10 includes a rotor 11 disposed within a compression chamber 12. The rotor is driven by a suitable electric motor (not shown) through a drive shaft 13 extending through a front head 14 of the compressor assembly. The compression chamber 12 is provided in a cylindrical 15 which is disposed between the front head 14 and a rear head 16 of the compressor assembly.

Figure 2:
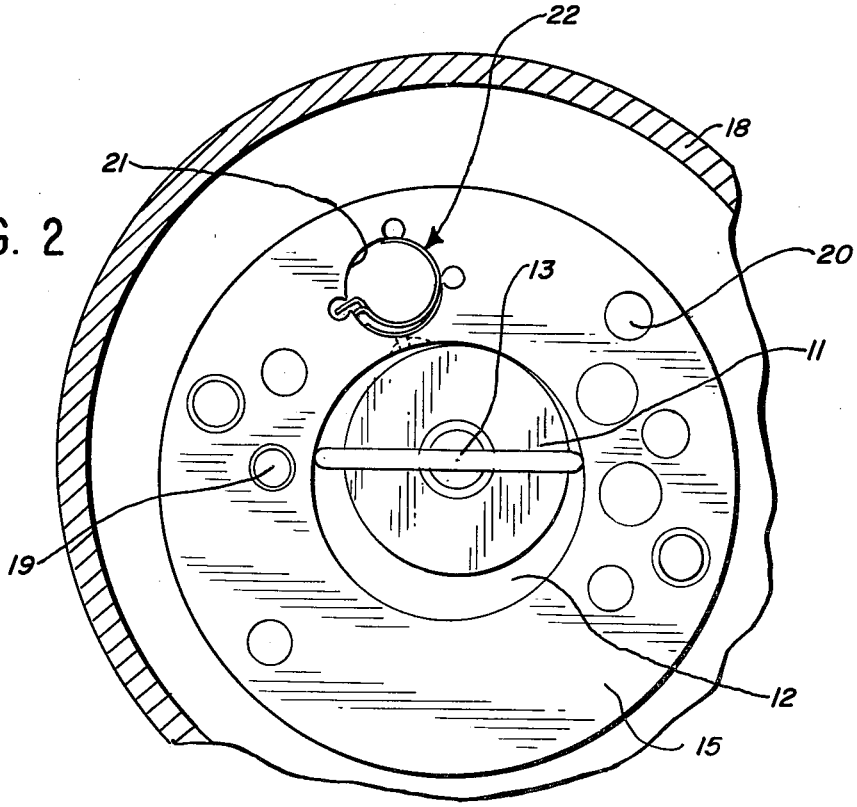
FIG. 2 is a fragmentary horizontal section taken substantially along the line 2—2 of FIG. 1.

Fluid is delivered to the rear head through an inlet conduit 17 extending through an outer housing 18 of the compressor assembly. As shown in FIG. 2, the cylinder 15 may be provided with a dowel pin hole 19 and a plurality of bolt holes generally designated 20. As further shown in FIG. 2, the cylinder defines a cylindrical discharge valve chamber 21 in which is mounted a discharge valve assembly generally designated 22.

Referring now more specifically to FIGS. 3–6, the discharge valve chamber 21 is preferably cylindrical. More specifically, the chamber is defined at least in part by a cylindrical wall surface portion 23 through which the outlet 24 from the compression chamber 12 opens. In the illustrated embodiment, chamber 21 defines a first cylindrical bore through the cylinder 15. Outlet 24 defines the discharge flow passage for conducting compressed fluids from the compression chamber 12 to the discharge valve chamber 21 in the normal operation of the compressor.

Figure 3:
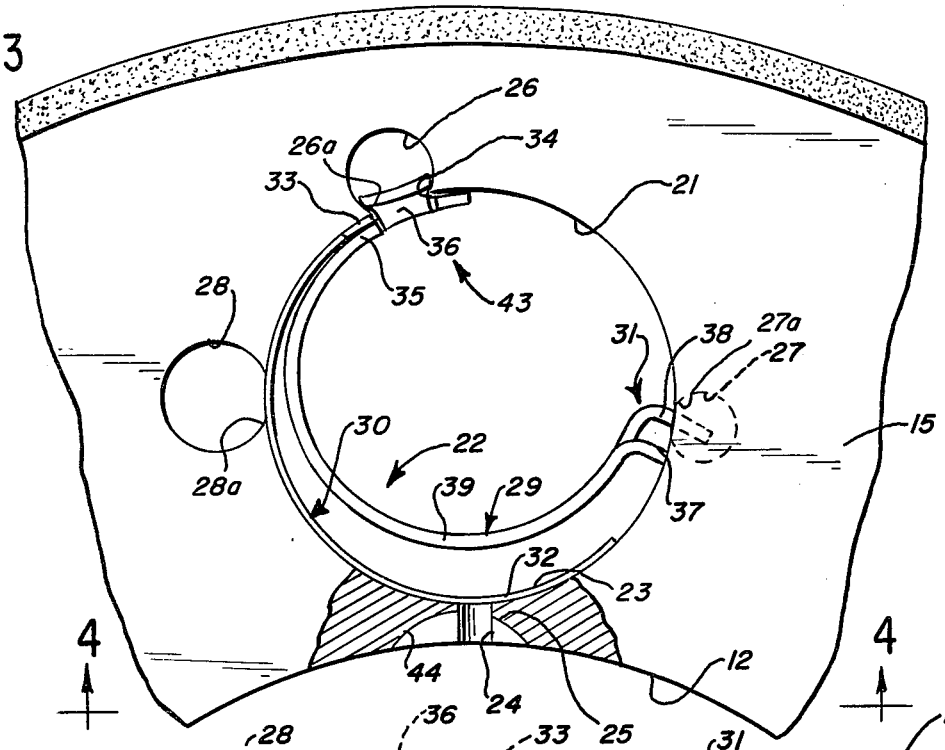
FIG. 3 is a fragmentary enlarged horizontal section illustrating in greater detail the discharge valve assembly.

As shown in FIG. 3, the portion 25 of cylinder 15 extending between the compression chamber 12 and discharge valve chamber 21 is relatively thin so that the length of the discharge outlet passage 24 is relatively small and thus the outlet passage entraps only a very small amount of the previously compressed fluid during a subsequent compressing operation of the rotor. As shown in FIG. 3, the compression chamber 12 is cylindrical and thus the wall portion 25 widens rapidly away from the outlet as a result of the diverging cylindrical configurations of the two chambers.

As further shown in FIG. 3, cylinder 15 is provided with a second cylindrical bore 26 generally opposite outlet 24, a third cylindrical bore 27 somewhat less than 90 degrees away from the outlet 24, and a fourth cylindrical bore 28 approximately 90 degrees from the outlet in the opposite direction from bore 27. Each of the three cylindrical bores 26, 27 and 28 intersects the cylindrical valve chamber 21 so as to open radially thereinto, thereby defining respective lip portions **26*a*, 27*a* and 28*a* as shown in FIG. 3**.

Figure 5:
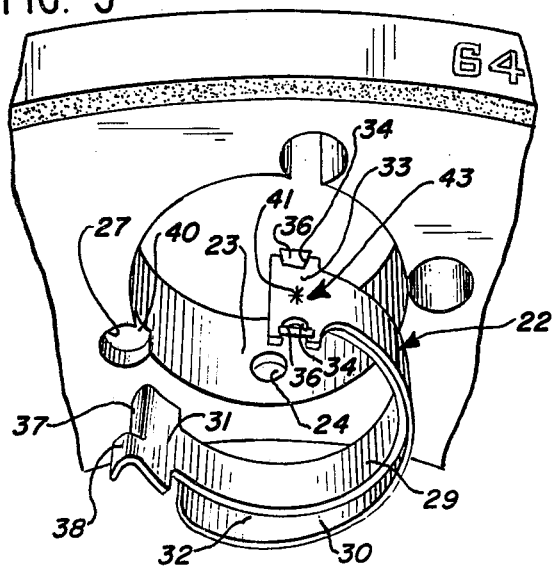
FIG. 5 is a fragmentary exploded perspective view illustrating the placement of the discharge valve assembly in the compressor wall means.
Figure 6:
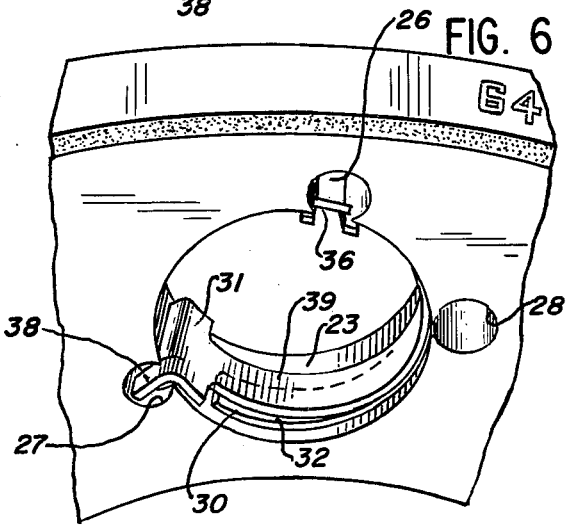
FIG. 6 is a perspective view illustrating the mounting of the discharge valve assembly in the discharge valve chamber in secured relationship with the wall means.

As indicated briefly above, the invention comprehends the provision of an improved discharge valve assembly 22 for use in controlling fluid flow through outlet 24 into the discharge valve chamber 21. As shown in FIG. 5, the valve assembly 22 comprises a pair of generally cylindrical elements 29 and 30. The elements are secured at one end 43 of the assembly 22 by suitable means, such as spot welding 41. In its free state, as shown in FIG. 5, the valve stop element 29 has a radius of curvature somewhat less than that of the valve member element 30. Resultingly, the distal end 31 of the valve stop element is spaced radially inwardly of the end portion 32 of the valve member element. In the illustrated embodiment, the radius of curvature of at least end portion 32 of the valve member element is, preferably, substantially equal to the radius of curvature of the cylindrical wall surface defining valve chamber 21. Resultingly, the valve member portion 32 has accurate facial engagement with the wall surface portion 23 when the valve assembly 22 is installed in the valve chamber 21, as shown in FIGS. 3 and 6.

Figure 4:
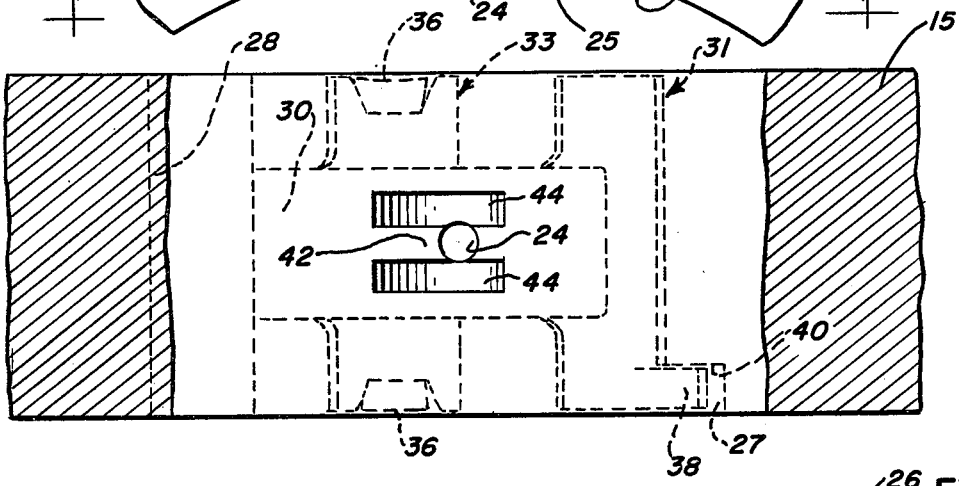
FIG. 4 is a fragmentary vertical view taken substantially along the line 4—4 of FIG. 3.

As further shown in FIG. 5, the other end portion 33 of valve member element 30 is provided with a pair of opposed outwardly opening recesses 34. The end portion 33 is axially enlarged. The corresponding end portion 35 of the valve stop 29 is enlarged and provided with a pair of formed tabs 36 which are turned radially outwardly to pass through the recesses 34 of the valve member end portion 33. As best seen in FIG. 4, the tabs 36 are generally trapezoidal and are received within the bore 26 so as to secure the end 33 of the valve assembly to the cylinder at recess 26.

As shown in FIG. 5, bore 27 extends only partially axially through the cylinder. Axially enlarged end 31 of the valve stop defines a first outturned flange 37 and a second outturned flange 38. As shown in FIG. 3, flange 37 bears against the cylinder wall adjacent the bore 27, whereas flange 38 passes into the bore 27 so as to be freely received therein.

Thus, as shown in FIG. 3, flange 37 effectively accurately spaces a backup support portion 39 of the valve stop radially inwardly of the outlet 24. Flange 38 retains the free end of the valve stop against circumferential displacement. Flange 38 further limits the axial movement of the valve assembly 22 into the discharge chamber 21 during assembly of the apparatus by its abutment with the cylinder wall at the bottom 40 of the bore 27.

The installed arrangement of the valve assembly 22 is illustrated in FIG. 6. As shown therein, valve member element 30 is self-biased into accurate facial engagement with the surface portion 23 of the chamber 21 adjacent the outlet opening 24, and the backup portion 39 of the valve stop is accurately spaced radially inwardly of the valve portion 32 so as to provide a preselected maximum permissible movement of the valve portion 32 in moving from the closed condition of FIGS. 3 and 6 of the drawing to an open position spaced from the outlet opening 24.

Referring now to FIG. 3, bore 28 opens into the valve chamber 21 behind the valve member element 30. As shown in FIG. 4, the axial height of the valve member element 30 is substantially less than the axial thickness of cylinder 15 and, thus, the axial length of the bore 28, so that oil trapped between the valve member 30 and the cylindrical wall surface defining the valve chamber 21 may flow readily back into the valve chamber from the top and bottom of the bore 28, thereby permitting accurate facial engagement of the valve member with the wall surface portion 23 as discussed above.

Referring to FIG. 4, the outlet opening 24 opens outwardly from the compression chamber 12 through a wall surface portion 42 which is further provided with a pair of cylindrical recesses 44 above and below the outlet opening 24 and intersecting the outlet opening.

Thus, it may be seen that the valve assembly 22 is extremely simple of manufacture while yet providing an improved mounting arrangement for the valve member 30. The use of the cylindrical discharge valve chamber 21 permits the outlet passage 24 to have effectively a minimum length and thus retain minimum amounts of compressed fluid during each rotation of the rotor 11. In the illustrated embodiment, the valve member element 30 has a cylindrical configuration defined by a radius equal to that of the cylindrical chamber 21. By limiting the flexure of the valve member 30 by means of the valve stop 29, the movement of the valve member is retained within its elastic limits and, thus, may effectively be seated in the normal arrangement of FIG. 3 during the useful life of the compressor. To assure an accurate conformity of the valve member element 30 to the cylindrical configuration of the valve chamber surface, the valve member element 30 is caused to have a constant radius. In actual practice, it is difficult to roll a flat strip of valve stock into an accurate strip having a constant radius because the end of the strip last rolled tends to take a radius greater than that of the rest of the strip. Such a valve member would be unsuitable for use in the instant invention.

Several techniques for forming a valve member with a constant radius have been devised. In one method of forming the valve member, the end portion 32 thereof was preformed to approximately the radius of the valve chamber and then the entire valve blank was rolled to complete the formation of the entire valve member with a radius accurately corresponding to the radius of the discharge valve chamber 21. Alternatively, in another method, the valve member was preformed by displacing the end portion 32 inward approximately 0.005" from the remainder of the valve member blank and the entire valve member blank then rolled to the desired accurate configuration.

By providing the valve assembly with a circumferential extent of over 180°, securing of the device in the valve chamber is facilitated. In the illustrated embodiment, the valve stop extends approximately 250° and the valve member extends approximately 210°.

Not only does the use of the cylindrical valve chamber 21 permit effective minimizing of the length of outlet passage 24, but further, the use of the cylindrical chamber permits facilitated manufacture thereof as by conventional drilling operations. The use of cylindrical bores for retaining the valve assembly 22 in position further facilitates manufacture. Thus, the invention provides a substantial economic improvement over the known devices utilizing relatively complex shapes and requiring expensive manufacturing operations such as milling a flat valve chamber surface and the like. The use of the cylindrical valve cavity arrangement permits the cavity to be located as desired in the cylinder by suitably drilling the chamber at any desired location.

The use of the bottom wall 40 in limiting the axial movement of the flange 38 into partial bore 27 provides an automatic accurate positioning of the valve device in the valve chamber thereby further facilitating manufacture and minimizing cost of the compressor.

The valve assembly and the associated valve chamber thus described are designed to permit machine insertion of the valve assembly 22, if desired.

The foregoing disclosure of specific embodiments is illustrative of the broad inventive concepts comprehended by the invention.

Having described the invention, the embodiments of the invention in which an exclusive property or privilege is claimed are defined as follows:

1. In a compressor apparatus including wall means having a first portion defining a compression chamber, an inlet passage opening to said chamber, and compressing means disposed within said chamber, an improved outlet structure comprising:

a second portion of said wall means defining a right-circularly cylindrical discharge valve chamber having a first surface portion spaced adjacent said compression chamber;

an outlet extending through said second portion of the wall means to provide a discharge passage from said compression chamber to said discharge valve chamber through said first surface portion;

a valve stop defining a resilient, arcuate backup portion, a securing portion secured to said wall means within said valve chamber;

a resilient semicylindrical roll-formed metallic valve member juxtaposed radially outwardly to said valve stop and biased into accurate facial engagement with said cylindrical first surface portion of the discharge valve chamber so as to permit discharge fluid flow through said discharge passage into said discharge valve chamber, the inward movement of the valve member being effectively limited by engagement thereof with said valve stop backup portion, said valve member comprising a thin element having a double rolled end portion aligned with said outlet and a single rolled portion extending from said end portion and secured to said wall means; and cooperating means on said valve stop and said wall means spaced substantially from said securing portion for maintaining said backup portion in spaced juxtaposed relationship to said outlet in the cylindrical surface portion of said second wall means portion, said cooperating means including first means for spacing said backup portion from said cylindrical surface portion and second means for aligning said backup portion with said outlet in a direction generally parallel to said cylindrical surface portion.

2. The compressor apparatus of claim 1 wherein said valve member single rolled portion is secured to said valve stop securing portion whereby said valve member is effectively secured to said wall means.

3. The compressor apparatus of claim 1 wherein said valve stop includes a plurality of turned end portions displaced both circumferentially and axially of each other and defining portions of said cooperating means.

4. In a compressor apparatus including wall means having a first portion defining a compression chamber, an inlet passage opening to said chamber, and compressing means disposed within said chamber, an improved outlet structure comprising:

a second portion of said wall means being provided with a machined discharge valve chamber having a first surface portion spaced adjacent said compression chamber;

an outlet extending through said second portion of the wall means to provide a discharge passage from said chamber to said discharge valve chamber through said first surface portion;

a third portion of said wall means being provided with a machined recess intersecting a second surface portion of said discharge valve chamber spaced circumferentially of said first surface portion to define an opening between said recess and discharge valve chamber;

a valve stop defining a resilient, arcuate backup portion having a flange extending through said opening into said recess for securing said valve stop to said wall means within said valve chamber, said valve stop further having spacing means for positioning said backup portion in spaced juxtaposed relationship to said first surface portion of the discharge valve chamber; and a resilient, arcuate valve member juxtaposed radially outwardly to said valve stop and biased into engagement with said first surface portion of the discharge valve chamber so as to permit discharge fluid flow through said discharge passage into said discharge valve chamber, the inward movement of the valve member being effectively limited by engagement thereof with said valve stop backup portion.

5. The compressor apparatus of claim 4 wherein said valve chamber and recess comprise axially parallel intersecting bores.

6. The compressor apparatus of claim 4 wherein said valve chamber and recess comprise axially parallel intersecting bores extending fully through said second and third wall means portions respectively.

7. The compressor apparatus of claim 4 wherein said compression chamber comprises a machined bore in said wall means first portion, said valve chamber and recess comprising axially parallel intersecting bores extending axially parallel to said compression chamber bore.

8. The compressor apparatus of claim 4 wherein said second portion of the wall means defines a minimum thickness portion at said outlet, said second portion widening abruptly laterally away from said outlet.

9. The compressor apparatus of claim 4 wherein said wall means includes a fourth portion defining a second recess spaced substantially from said first recess and receiving an end portion of the valve stop for further securing the valve stop in the valve chamber.

10. In a compressor apparatus including wall means having a first portion defining a compression chamber, an inlet passage opening to said chamber, and compressing means disposed within said chamber, an improved outlet structure comprising:

a second portion of said wall means defining a cylindrical discharge valve chamber having a first surface portion spaced adjacent said compression chamber;

an outlet extending through said second portion of the wall means to provide a discharge passage from said compression chamber to said discharge valve chamber through said first surface portion;

a third portion of said wall means defining a cylindrical bore having a diameter substantially less than the diameter of said discharge valve chamber, the axis of said bore being parallel to the axis of said valve chamber, the wall surface of said bore intersecting a second surface portion of said discharge valve chamber spaced circumferentially of said first surface portion to define an opening between said bore and discharge valve chamber;

a valve stop comprising a resilient, arcuate backup portion and having a securing portion extending through said opening into said bore for securing said valve stop to said wall means within said valve chamber, said valve stop further having spacing means for positioning said backup portion in spaced juxtaposed relationship to said first surface portion of the discharge valve chamber; and a resilient, arcuate valve member juxtaposed radially outwardly to said valve stop and biased into engagement with said first surface portion of the discharge valve chamber so as to permit discharge fluid flow through said discharge passage into said discharge valve chamber, the inward movement of the valve member being effectively limited by engagement thereof with said valve stop backup portion.

11. The compressor apparatus of claim 10 wherein said valve stop is semicylindrical.

12. The compressor apparatus of claim 10 wherein said valve member is formed of spring steel and has a free radius substantially equal to that of the valve chamber.

13. The compressor apparatus of claim 10 including a third portion of said wall means spaced circumferentially from said first and second wall portions defining a second cylindrical bore having an axis parallel to the axis of said discharge valve chamber and disposed such that said discharge valve chamber and said second bore define an opening therebetween, said valve stop including a flange portion spaced from said securing portion and extending into said second bore.

14. The compressor apparatus of claim 10 wherein said means for positioning said valve stop comprises an angled end portion thereof diametrically opposite said securing portion and engaging said second portion of said wall means so as to retain said valve stop end portion in sapced relationship with said wall means in said discharge valve chamber.

15. The compressor apparatus of claim 10 wherein said opening defined by said bore and discharge valve chamber is defined by a lip portion, and said valve stop securing portion radially outwardly underlies said lip portion, thereby preventing radially inward movement of said valve stop within said valve chamber.

16. The compressor apparatus of claim 10 wherein said wall means comprises a cast iron cylinder member and said discharge valve chamber and bore are defined by machined portions of said member.

17. In a compressor apparatus including wall means having a first portion defining a compression chamber having a cylindrical outlet portion, an inlet passage opening to said chamber, and compressing means disposed within said chamber, an improved outlet structure comprising:

a second portion of said wall means defining a discharge valve chamber having a cylindrical surface portion spaced adjacent said compression chamber;

an outlet extending through said second portion of the wall means from said compression chamber outlet portion to said discharge valve chamber cylindrical surface portion to provide a discharge passage, said second portion of the wall means further defining a recess opening radially inwardly through said cylindrical surface portion;

a valve stop secured to said wall means within said valve chamber, said valve stop having a backup portion;

a resilient, arcuate valve member juxtaposed radially outwardly to said valve stop and biased into engagement with said cylindrical surface portion of the discharge valve chamber so as to permit discharge fluid flow through said discharge passage into said discharge valve chamber, the inward movement of the valve member being effectively limited by engagement thereof with said valve stop backup portion; and cooperating means on said valve stop and said wall means for maintaining said backup portion in spaced juxtaposed relationship to said outlet in the cylindrical surface portion of said second wall means portion, said cooperating means including a first turned portion of the valve stop engaging said cylindrical surface portion for effectively maintaining at least a minimum spacing of said backup portion from said cylindrical surface portion at all times, and a second turned portion of the valve stop received in said radially opening recess for aligning said backup portion with said outlet in a direction generally parallel to said cylindrical surface portion and maintaining said valve stop against displacement circumferentially of said cylindrical surface portion.

18. The compressor apparatus of claim 17 wherein said discharge passage opens radially through said cylindrical surface portion of the discharge valve chamber approximately 90° away from said recess.

19. The compressor apparatus of claim 17 wherein said turned portions of the valve stop comprises end portions thereof.

20. The compressor apparatus of claim 17 wherein said compression chamber outlet portion is defined by at least one cylindrical groove opening radially into said compression chamber and inserting a portion of said outlet.

21. The compressor apparatus of claim 17 wherein said valve stop is secured to said wall means at a position in said valve chamber substantially opposite said discharge passage.

22. The compressor apparatus of claim 17 wherein said valve stop defines a distal end movable relative to said cylindrical surface portion of the wall means defining said turned portions, said turned portions being spaced longitudinally of said valve stop.

23. The compressor apparatus of claim 17 wherein said valve stop defines a distal end movable relative to said cylindrical surface portion of the wall means defining said turned portions, said turned portions being spaced longitudinally of said valve stop, said first turned portion being displaced relative to said second turned portion in a direction parallel to the axis of said cylindrical surface portion.

* * * * *

UNITED STATES PATENT AND TRADEMARK OFFICE

CERTIFICATE OF CORRECTION

PATENT NO. : 4,199,309

DATED : April 22, 1980

INVENTOR(S) : RALPH F. CONNOR

It is certified that error appears in the above-identified patent and that said Letters Patent are hereby corrected as shown below:

Column 10, (Claim 20), line 29, after "and" cancel "inserting" and substitute therefor --intersecting--.

Signed and Sealed this

*Twenty-ninth* Day of *July 1980*

[SEAL]

*Attest:*

SIDNEY A. DIAMOND

*Attesting Officer*

*Commissioner of Patents and Trademarks*